US006199218B1

(12) United States Patent
Michael

(10) Patent No.: US 6,199,218 B1
(45) Date of Patent: Mar. 13, 2001

(54) ACCESSORY EYEGLASS CASE

(76) Inventor: Mary Jayne Michael, 3281 N. Port Clinton Rd., Fremont, OH (US) 43420

( * ) Notice: Subject to any disclaimer, the term of this patent is extended or adjusted under 35 U.S.C. 154(b) by 0 days.

(21) Appl. No.: 09/151,143

(22) Filed: Sep. 10, 1998

(51) Int. Cl.[7] ..... A45C 11/04; A41D 27/20
(52) U.S. Cl. ..... 2/247; D3/265; 206/5
(58) Field of Search ..... 206/5; D03/265, D03/266; 248/309.2; 24/13; 63/20; D11/40, 42; 2/243.1, 244, 245, 246, 247, 206, 11

(56) References Cited

U.S. PATENT DOCUMENTS

| | | | | |
|---|---|---|---|---|
| D. 141,037 | * | 5/1945 | Ripin | D57/1 |
| D. 144,445 | * | 4/1946 | Barrett et al. | D57/1 |
| D. 159,080 | * | 6/1950 | Krieger | D57/1 |
| D. 172,039 | * | 4/1954 | Nathan | D57/1 |
| D. 176,236 | * | 11/1955 | Stegeman | D57/1 |
| D. 243,291 | * | 2/1977 | Mechaly et al. | D2/25 |
| D. 266,205 | * | 9/1982 | Berman | D3/34 |
| D. 281,636 | * | 12/1985 | Cressy-Renoma | D2/28 |
| D. 352,825 | * | 11/1994 | Hsieh | D3/265 |
| 467,386 | * | 1/1892 | Steadley | 351/158 |
| 2,686,313 | * | 8/1954 | Seidler | 2/75 |
| 2,935,662 | * | 5/1960 | Hausmann | 317/159 |
| 3,438,062 | * | 4/1969 | Dobell | 2/247 |
| 4,218,781 | * | 8/1980 | Lieberman | 2/247 |
| 4,266,300 | * | 5/1981 | Partidge | 2/247 |
| 4,389,801 | * | 6/1983 | Sharrock et al. | 40/159 |
| 4,418,733 | * | 12/1983 | Kallman | 383/11 |
| 4,485,496 | * | 12/1984 | Shanks, Jr. | 2/247 |
| 4,507,882 | * | 4/1985 | Harrell | 36/136 |
| 4,602,390 | * | 7/1986 | Morera et al. | 2/251 |
| 4,651,355 | * | 3/1987 | White | 2/247 |
| 5,054,127 | * | 10/1991 | Zevchak | 2/247 |
| 5,210,881 | * | 5/1993 | Stocker, Jr. et al. | 2/247 |
| 5,240,105 | * | 8/1993 | Tsai | 206/5 |
| 5,593,073 | * | 1/1997 | Finnegan | 224/183 |
| 5,809,576 | * | 9/1998 | Huston et al. | 2/247 |
| 5,929,967 | * | 7/1999 | Conner | 351/158 |
| 5,946,732 | * | 9/1999 | Richards | 2/247 |

OTHER PUBLICATIONS

Gershman, Maurice Journal of the American Medical Asso. vol. 168 No. 7, p. 930 Oct. 1958.*

* cited by examiner

*Primary Examiner*—John J. Calvert
*Assistant Examiner*—Alissa L. Hoey
(74) *Attorney, Agent, or Firm*—Jerry Semer

(57) ABSTRACT

This invention is an accessory for a garment. It is designed to decorate the garment. The invention also has a practical use in that it is a pouch for glasses. The invention is a decoration for a garment on which a pouch that is of sufficient size to hold a pair a glasses is attached to the back of the decoration. The decoration fully covers the glasses so that the glasses do not detract from the decor of the garment. The glasses can not be seen by an individual viewing the invention from the front. On the back of the pouch are four methods to attach the invention to the garment. One method to attach the invention to the garment is a magnetic strip on the back of the pouch. This magnetic strip on the pouch is placed against the garment and on the underside of the garment another magnetic strip is placed against the magnetic strip on the back of the invention with the garment in between. This will hold the invention to the garment without placing an opening in the garment.

19 Claims, 6 Drawing Sheets

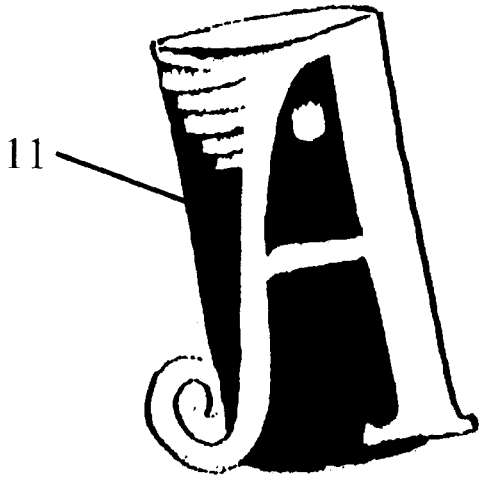
FIG. 7
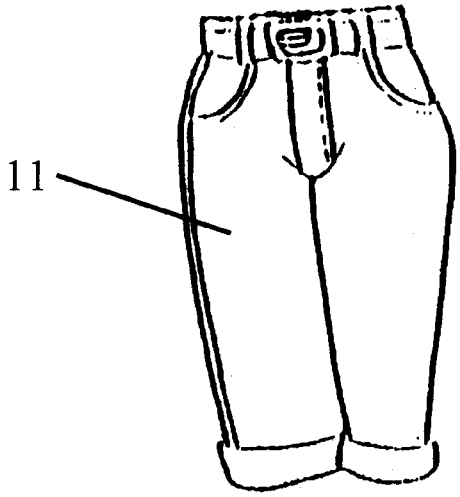
FIG. 5
FIG. 6
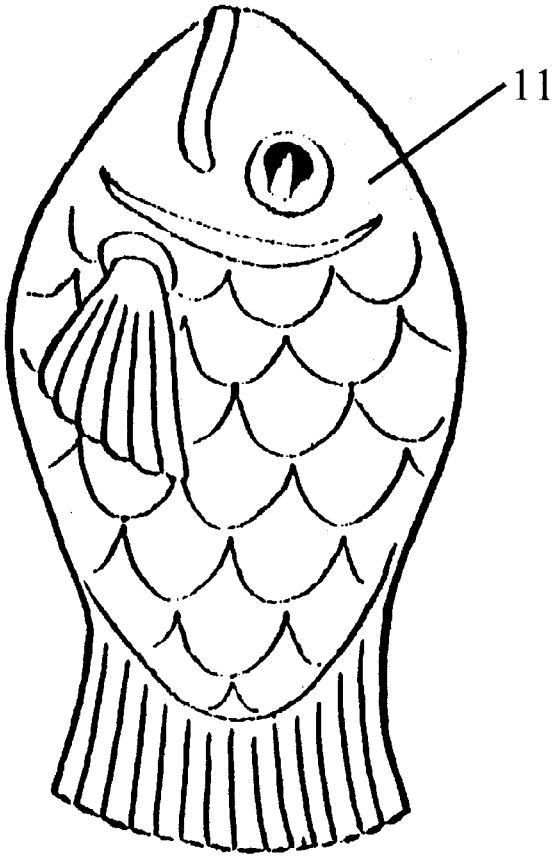

ACCESSORY EYEGLASS CASE

FIELD OF THE INVENTION

This invention relates to an accessory for a garment and more particularly to an accessory that has both decorative and practical uses.

BACKGROUND OF THE INVENTION

Most accessories to dresses are just designed to accent the dress. The applicant has designed an accessory that has both decorative value and practical value.

A large number of individuals in the United States wear glasses. Although this number has decreased with the wearing of contact lenses the number is still significant. Also between the ages 45 and 55, most individual's eyes change. This is true about people who need corrective lenses. Usually they find it difficult to do close work or read. People with normal eye sight that have no need for corrective lenses, also between the ages of 45 and 55, their eyes change and they have difficulties doing close work and reading. A large number of these individuals who wear contact lenses and do not wish to wear glasses or individuals with normal long distance sight, now use reading glasses to do close work and reading. In order for an individual to use reading glasses, he must take off the glasses when he is viewing something at a distance. This causes the problem of where to put the glasses when they are not in use. One cannot place the glasses in pockets of the pants since these pockets are designed in areas which when one sits bend. The bending could damage the glasses or injure the person. Also, a large number of garments that fit over the upper torso, do not have pockets for the glasses. This is especially true about women's wear. Thus, one of the objectives of this invention is to create an accessory for holding glasses. There are several different pouches that have been designed for glasses.

These are shown in U.S. Pat. No. 467,386 to F. W. Steadley, U.S. Pat. No. 3,749,231 to Nathan, U.S. Pat. No. 319,293 to S. F. Merritt, U.S. Pat. No. 3,994,391 to Holland, U.S. Pat. No. 4,418,733 to Kallman, U.S. Pat. No. 4,458,384 to Arnold, U.S. Pat. No. 5,129,509 to Romolt, U.S. Pat. No. 4,966,322 to Zagorski et al, U.S. Pat. No. 5,033,612 to Bivins, and U.S. Pat. No. 5,261,582 to Mathews et al. However, none of these pouches have been designed as an accessory for a garment. None of these pouches are designed to fit the decor of the garment on which they are placed. Thus, one of the objectives of applicant's invention is to design an accessory that is both decorative and fits into the decor of the garment as well as being practical in that it will hold glasses.

Applicant has also designed her accessory to be attached to a garment in numerous ways. One of the objectives of the invention is to design the accessory that attaches easily and in many ways so that the individual can wear the accessory with many outfits and in many ways. Also with many garments one does not wish to place pin holes in the garment. One of the objectives of this invention is to create an accessory for a garment that can be attached to the garment without placing a hole in the garment or damaging the garment in any way. The feature that achieves this objective is a magnetic pinning system.

SUMMARY OF THE INVENTION

This invention is an accessory for a garment. It is designed to decorate the garment. The invention also has a practical use in that it is a pouch for glasses. The invention is a decoration for a garment on which a pouch that is of sufficient size to hold a pair of glasses is attached to the back of the decoration. The pouch is slightly stiffened such that the glasses can be put in and pulled out easily. The decoration fully covers the glasses so that the glasses do not detract from the decor of the garment. The glasses can not be seen by an individual viewing the invention from the front. The decoration is designed to fit the decore of the garment. On the back of the pouch are four methods to attach the invention to the garment. The back of the pouch has a pin. The pin can be used to attach the invention to the garment. The back of the invention also has a loop of fabric that can be used to attach the invention to the garment with a belt or with a necklace. Also on the back of the pouch is a hook to attach the invention to the garment or belt loop. Another method to attach the invention to the garment is a magnetic strip on the back of the pouch. This magnetic strip on the pouch is placed against the garment and on the underside of the garment another magnetic strip is placed against the magnetic strip on the back of the invention with the garment in between. This will hold the invention to the garment without placing a opening in the garment.

BRIEF DESCRIPTION OF THE DRAWING

FIG. 5 is a front view of another embodiment of the invention.

FIG. 6 is a front view of another embodiment of the invention.

FIG. 9 is a front view of another embodiment of the invention.

DETAILED DESCRIPTION OF THE PREFERRED EMBODIMENT

Figure 1:
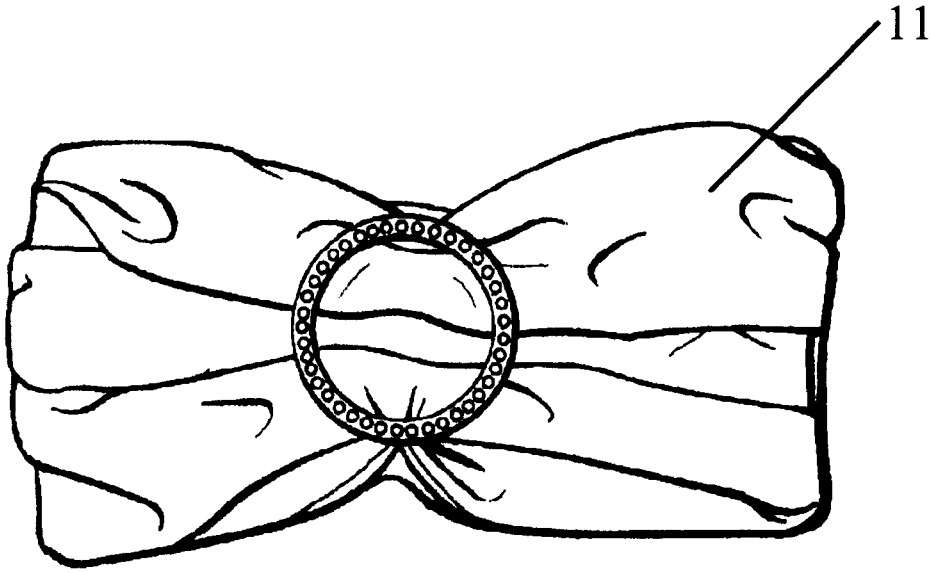
FIG. 1 is a front view of the invention.
Figure 2:
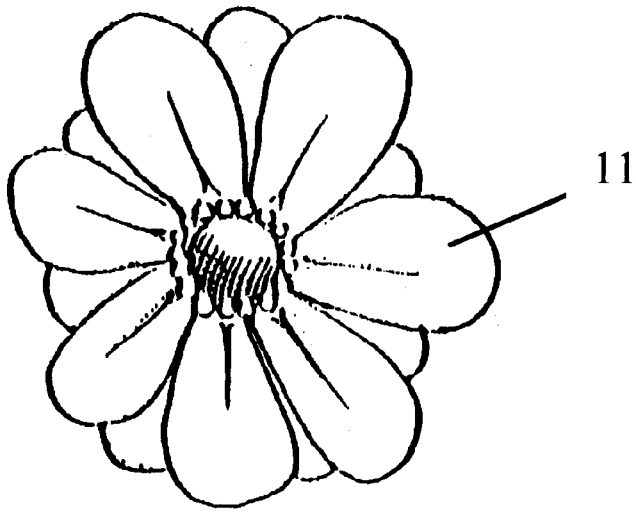
FIG. 2 is a front view of another embodiment of the invention.
Figure 4:
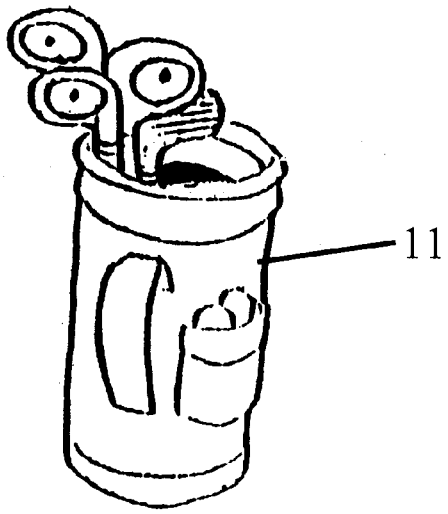
FIG. 4 is a front view of another embodiment of the invention.
Figure 3:
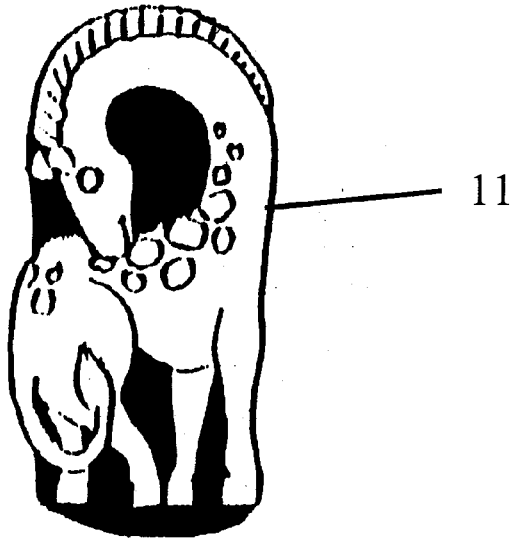
FIG. 3 is a front view of another embodiment of the invention.
Figure 8:
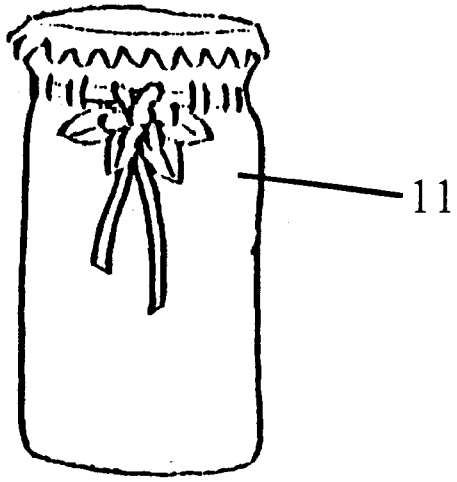
FIG. 8 is a front view of another embodiment of the invention.
Figure 7:
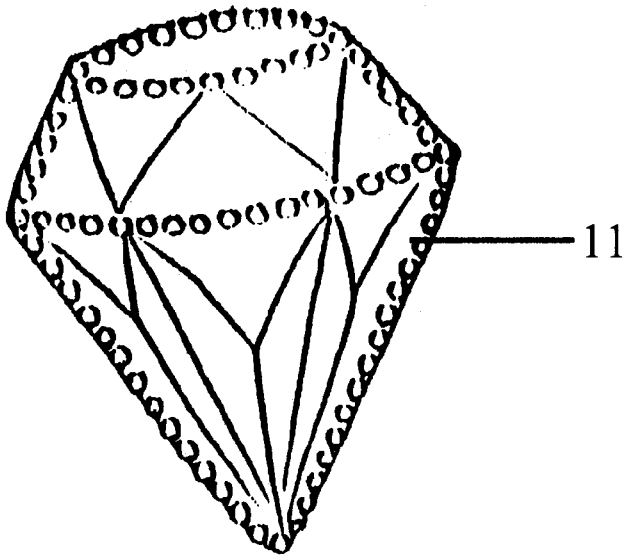
FIG. 7 is a front view of another embodiment of the invention.

FIGS. 1, 2, 3, 4, 5, 6, 7, 8 and 9 show the front view of six embodiments of the invention. As shown in these figures the invention is designed to fit the decor of the garment and to accent the garment. FIG. 1 shows the invention front 11 designed as a bow. FIG. 2 shows the invention front 11 designed as a flower. FIG. 7 shows the invention front 11 as the trademark "A" of the invention. FIG. 9 shows the invention as a diamond. These accessories were designed for apparel for work or a more formal occasion. FIGS. 3, 4, 5, and 8 shows the invention embodiments designed for a more sporty occasion. FIG. 3 shows a giraffe as the inventions front 11. FIG. 4 shows a golf bag with clubs as the front 11 of the invention. FIG. 5 shows the invention's front 11 as a pair of pants. FIG. 8 shows the invention as a drawstring pouch. FIG. 6 is designed to be worn with swim wear and the invention's front 11 is designed to look like a fish.

Figure 10:
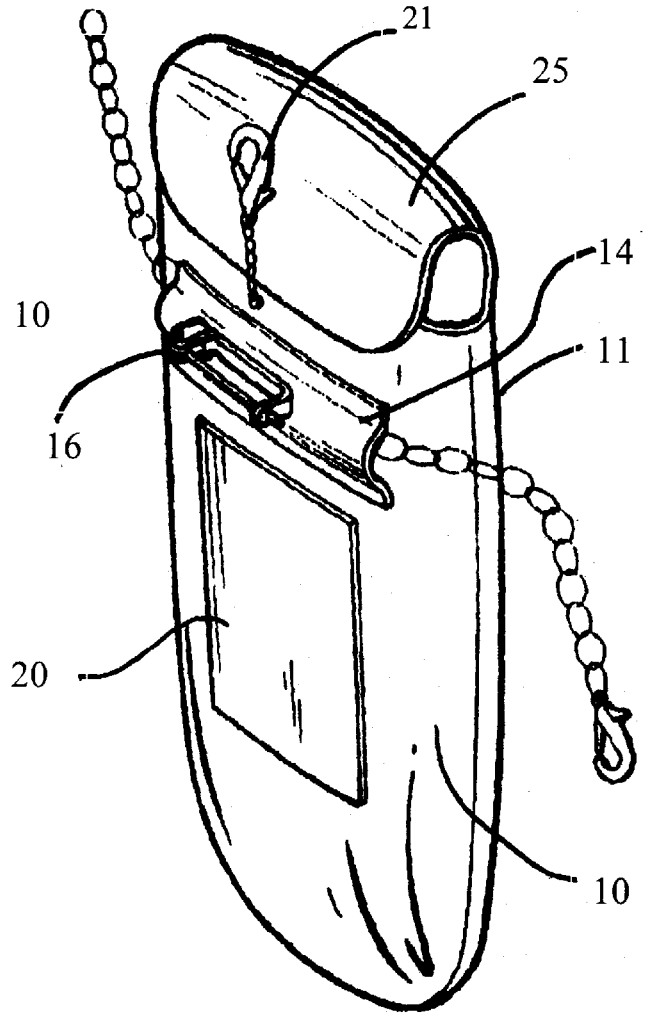
FIG. 10 is the back view of the invention with the pouch having a flap closing.

FIG. 10 shows a back view of the invention. From this figure one can see that the invention is not only an accessory to a dress but also an eye glass case. It should be noted that in all the embodiment the glasses are fully covered by the invention's front 11 and can not be seen from a front view, thus an individual seeing a person wearing the invention would not realize that the person wearing the invention was wearing a glass case.

Figure 13:
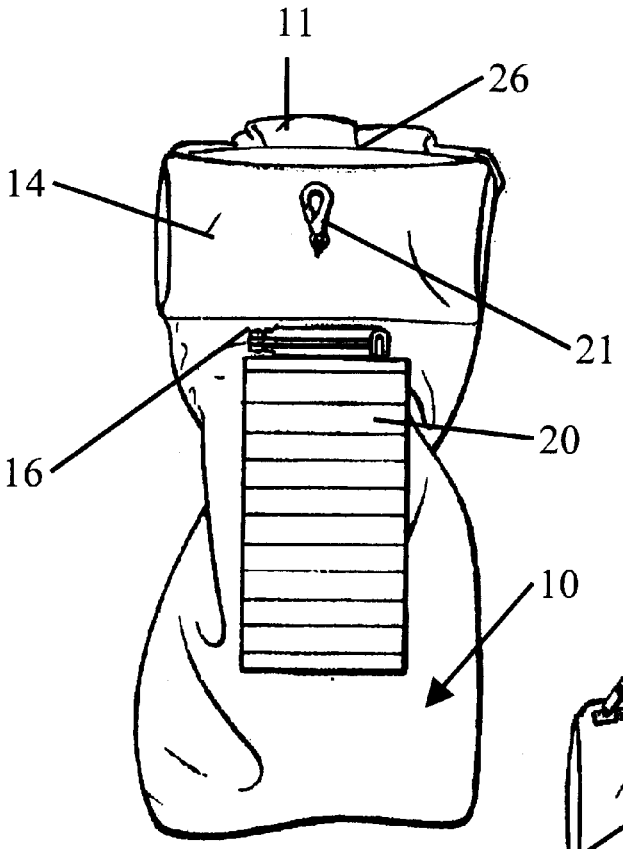
FIG. 13 is a view of the invention with the pouch having an open top.
Figure 12:
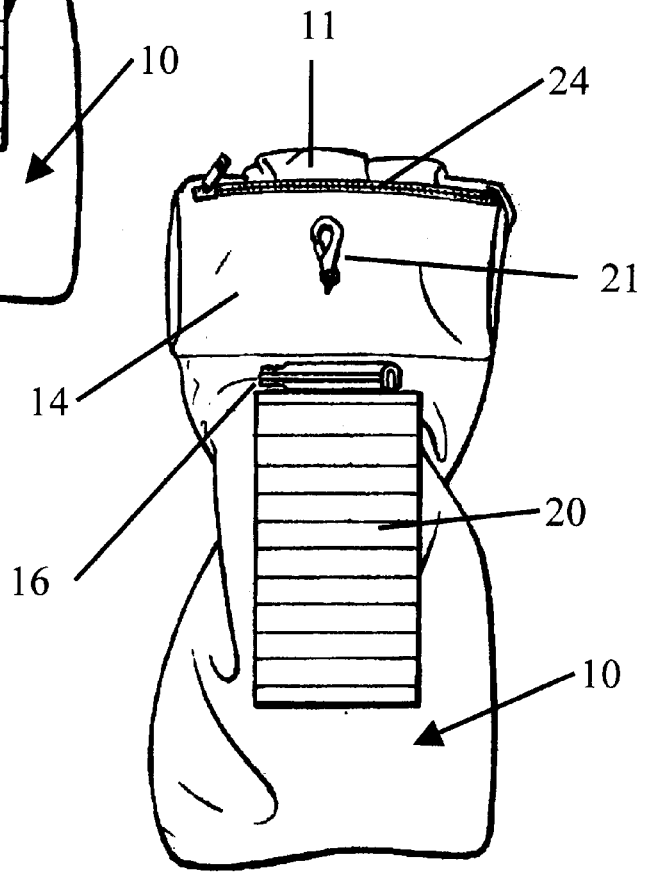
FIG. 12 is a view of the invention with the pouch having a zipper closing.

FIG. 10 shows the back view of the invention. Attached to the invention's front 11 is pouch 10 for holding glasses. The pouch has an open top so that glasses can be placed within. In this embodiment of the invention shown in FIG. 10 the top of the case has a flap 20 to cover the glasses. In this embodiment the flap 20 seals the glasses within the case with a closure made from hook and loop fabric such as Velcro 22. In another embodiment shown in FIG. 12 the pouch has no flap but is closed with a zipper 24. In another embodiment shown in FIG. 13 the pouch has no means for closure and has a completely open top 26.

On the back 12 of pouch 10 of the invention are four different methods in which the invention can be attached to a garment 15. FIG. 10 shows a small hook 21 that can be used to hook the pouch 10 to the garment 15. The hook 21 can also be used to hook the pouch 10 to a belt loop 17 as shown in FIG. 11.

FIG. 10 also shows a loop 14 that can hook the pouch 10 to the garment's belt. The loop 14 can also be used to hook the pouch 10 to a necklace or a bracelet as shown in FIG. 10. FIG. 10 shows a pin 16 that could be used to pin the pouch 10 to the garment 15

Figure 11:
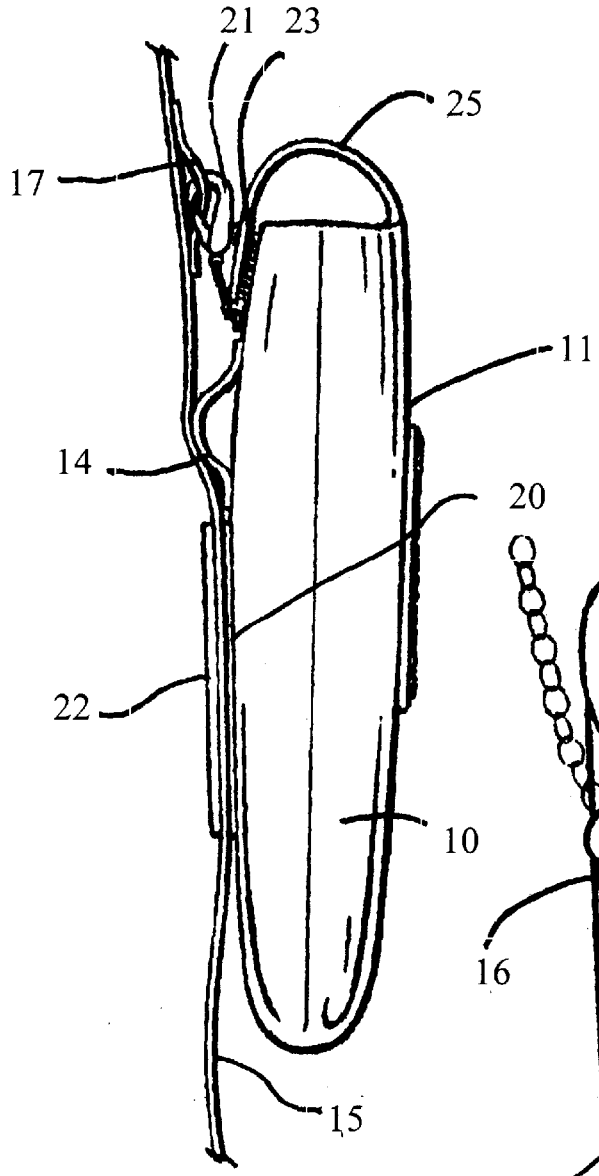
FIG. 11 is a view of the invention showing the magnetic closing and the garment.

FIGS. 10 and 11 also shows a method for attaching the pouch 10 to a garment 15 that does not place a hole in the garment 15. FIG. 10 shows a magnetic strip 20 on the back of the pouch 10. FIG. 11 shows the pouch 10 being attached to a garment 15 with a magnetic strip 20. FIG. 11 shows that the pouch 10 is placed against the garment 15 and another magnetic strip 22 is placed on the underside of the garment 15 against the magnetic strip 20 of the pouch 10. This method of closure will securely hold the pouch 10 in position without placing a hole in the garment.

Figure 14:
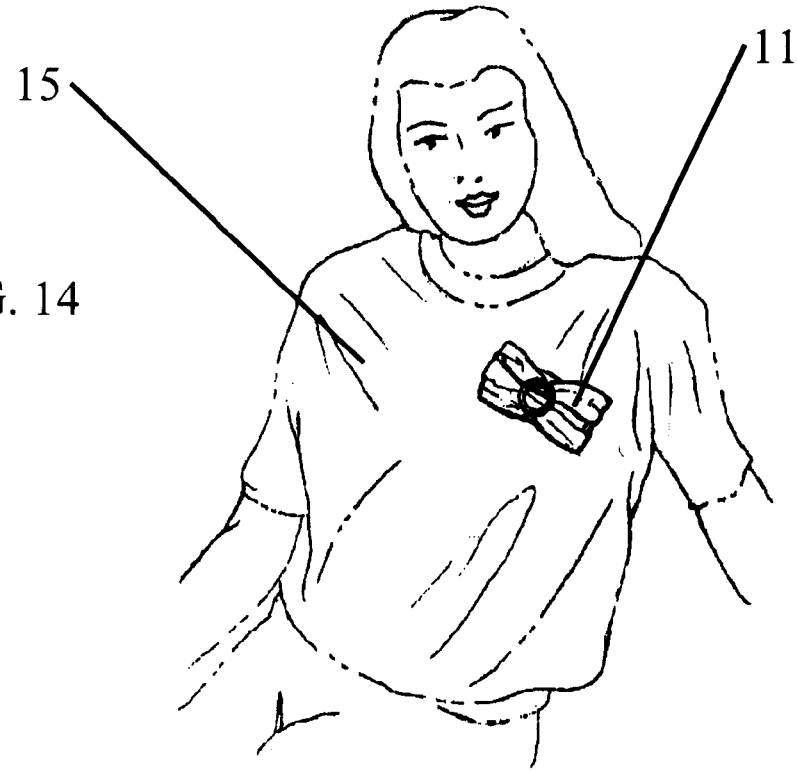
FIG. 14 is a front view of the invention on a garment.

As pointed out above pouch 10 is fully covered by the invention's front 11 so that the pouch 10 and the glasses will not detract from the decor of the garment 15 as shown in FIG. 14. FIG. 14 shows the invention being worn on a dress. Also, by fully covering the glasses, this protects the glasses from scratching and other problems.

The pouch 10 in this instance is basically a small pouch that has dimensions such that glasses can easily fit within the pouch 10. The pouch 10 can be formed with stiffeners so that the glasses will more easily fit within. The material which makes up the pouch 10 insides is designed such that it will not scratch the glasses. In the preferred embodiment this material is chamois.

The invention's front 11 is designed so that it fits the decor of the garment 15 as shown in FIG. 11. As shown in FIGS. 1 through 9, the invention's front 11 can be designed in many ways as long as it fits the decore of the garment 15.

Changes and modifications in the specificity described embodiments can be carried out without departing from the scope of the invention which is intended to be limited only by the scope of the appending claims.

I claim:

1. An accessory for a garment comprising:

a) a decoration for the garment with a back and a front and said front of the decoration is designed such as it fits the decor of the garment such that said decoration looks as if it is an accessory to the garment; and, b) a pouch with an opening at the top and with a front and back and the front of said pouch is attached to the back of said decoration and said pouch is adapted to hold a pair of glasses and said decoration conceals the entire front of the pouch and any portion of the glasses not covered by the pouch and said pouch has an inner surface an said inner surface is made out of material that will not scratch the glasses; and, c) a means for attaching the accessory to the garment on the back of the pouch that does not damage the garment when the accessory is removed; and, d) when the accessory is placed on the garment, the pouch is attached to the decoration in such a way that when the pouch has glasses within neither the pouch nor the glasses can be seen by a person viewing the garment from the front.

2. An accessory for a garment as in claim 1 wherein;

a) the means for attaching the accessory to the garment enables the accessory to be attached to the garment without placing an opening within the garment.

3. An accessory for a garment as in claim 2 wherein:

a) the means of attaching the accessory to the garment without placing an opening in the garment comprises:

(1) a first magnetic strip placed on the back of the pouch; and, (2) the accessory is placed over the garment where it is to be worn and said garment has an underside and a front side; and, (3) a second magnetic strip is placed on the underside of the garment at the point where the magnetic strip on the back of the pouch has been placed on the front side of the garment.

4. An accessory to the garment as in claim 3 further comprising:

a) a second means for attaching said accessory to the garment that is a pin on back of the pouch.

5. An accessory to the garment as in claim 4 further comprising:

a) a third means for attaching said accessory to the garment on back of the pouch which is a hook.

6. An accessory to the garment as in claim 5 further comprising:

a) a forth means for attaching said accessory to the garment on back of the pouch which us a loop of fabric.

7. An accessory to the garment as in claim 1 further comprising:

a) a second means for attaching said accessory to the garment on back of the pouch.

8. An accessory to the garment as in claim 7 further comprising:

a) a third means for attaching the accessory to the garment on the back of the pouch.

9. An accessory to the garment as in claim 8 further comprising:

a) a fourth means for attaching the accessory to the garment on the back of the pouch.

10. An accessory to the dress as in claim 1 wherein;

a) the decoration resembles a bow.

11. An accessory to the dress as in claim 1 wherein;

a) the decoration resembles a flower.

12. An accessory to the dress as in claim 1 wherein;

a) the decoration resembles a fish.

13. An accessory to the dress as in claim 1 wherein;

a) the decoration resembles a golf bag.

14. An accessory to the dress as in claim 1 wherein;

a) the decoration resembles a giraffe.

15. An accessory to the dress as in claim 1 wherein;

a) the decoration resembles a drawstring pouch.

16. An accessory to the dress as in claim 1 wherein;

a) the decoration resembles a diamond.

17. An accessory to the dress as in claim 1 wherein;

a) the decoration resembles the letter "A".

18. An accessory to the dress as in claim 1 wherein;

a) the decoration resembles a pair of pants.

19. An accessory to the dress as in claim 1 wherein;

a) the inner surface of the pouch is made of chamois.

* * * * *